US007059152B2

(12) United States Patent
Oakey et al.

(10) Patent No.: US 7,059,152 B2
(45) Date of Patent: Jun. 13, 2006

(54) NITROGEN REJECTION METHOD AND APPARATUS

(75) Inventors: John Douglas Oakey, Godalming (GB); Brian Morice Davies, Summit, NJ (US)

(73) Assignee: The BOC Group plc (GB)

( * ) Notice: Subject to any disclaimer, the term of this patent is extended or adjusted under 35 U.S.C. 154(b) by 0 days.

(21) Appl. No.: 10/701,702

(22) Filed: Nov. 5, 2003

(65) Prior Publication Data

US 2004/0182109 A1 Sep. 23, 2004

(30) Foreign Application Priority Data

Nov. 19, 2002 (GB) ..... 0226983

(51) Int. Cl.
*F25J 3/00* (2006.01)

(52) U.S. Cl. ..... 62/620; 62/927

(58) Field of Classification Search ..... 62/927, 62/620, 621, 628

See application file for complete search history.

(56) References Cited

U.S. PATENT DOCUMENTS

| | | | | |
|---|---|---|---|---|
| 2,959,022 | A * | 11/1960 | Twomey | 62/623 |
| 3,348,384 | A | 10/1967 | Harmens | |
| 3,507,127 | A * | 4/1970 | De Marco | 62/621 |
| 3,721,099 | A * | 3/1973 | Forg et al. | 62/612 |
| 3,797,261 | A * | 3/1974 | Juncker et al. | 62/622 |
| 4,415,345 | A * | 11/1983 | Swallow | 62/630 |
| 4,435,198 | A | 3/1984 | Gray | |
| 4,455,158 | A * | 6/1984 | Vines et al. | 62/622 |
| 5,141,544 | A * | 8/1992 | Butts | 62/628 |
| 5,617,741 | A * | 4/1997 | McNeil et al. | 62/622 |
| 5,802,871 | A * | 9/1998 | Howard et al. | 62/627 |

FOREIGN PATENT DOCUMENTS

| | | |
|---|---|---|
| DE | 35 22 370 A1 | 1/1987 |
| DE | 102 15 125 A1 | 10/2003 |
| EP | 1 275 920 A1 | 1/2003 |
| GB | 2 298 034 A | 8/1996 |

OTHER PUBLICATIONS

Craig A. Pruitt, J. V. O'Brien; "Wyoming's Shute Creek Plant Uses NRU Unit," Oil & Gas Journal, Oct. 9, 1989, pp. 78-82.

* cited by examiner

*Primary Examiner*—William C. Doerrler
(74) *Attorney, Agent, or Firm*—Philip H. Von Neida

(57) ABSTRACT

Nitrogen is rejected from a feed natural gas stream comprising methane and nitrogen so as to form a primary methane product. The mole fraction of nitrogen in the feed natural gas increases over a period of time. The feed natural gas stream is cooled in a main heat exchanger and is rectified in a double rectification column. A primary product methane stream and a secondary nitrogen-enriched product stream are withdrawn from the rectification column. The secondary nitrogen-enriched product stream has a mole fraction of methane at or above a chosen minimum value when the said mole fraction of nitrogen is at a minimum. When the said mole fraction of nitrogen rises to a value at which the mole fraction of methane in the secondary nitrogen-enriched product stream falls below the chosen minimum, a part of the feed gas is introduced through conduit into the secondary nitrogen-enriched product stream so as to restore its mole fraction of methane to the chosen minimum value or a value thereabove.

12 Claims, 1 Drawing Sheet

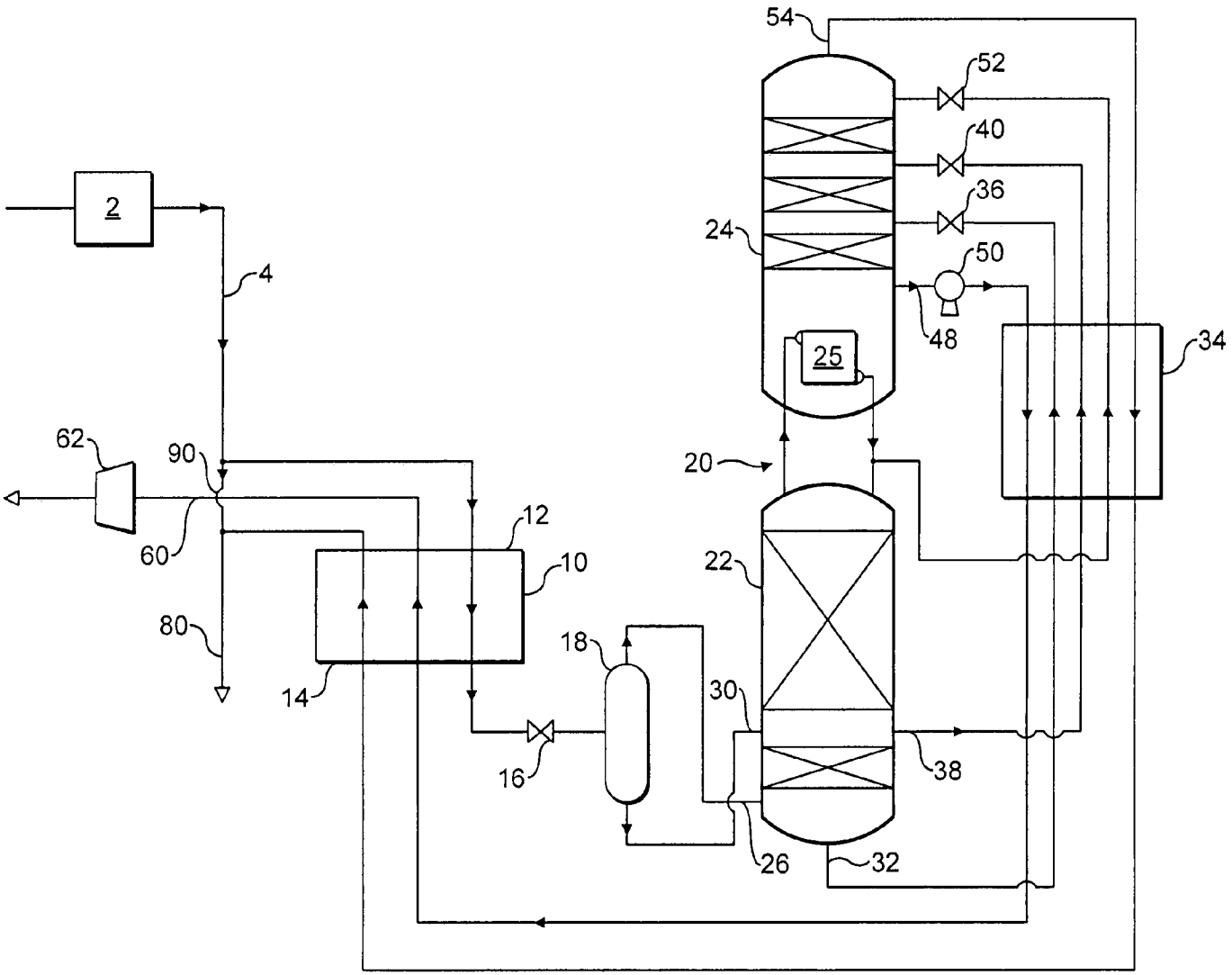
34
52
40
36
50
48
38
32
54
25
24
20
22
30
26
18
10
12
16
14
4
90
60
80
2
62

NITROGEN REJECTION METHOD AND APPARATUS

BACKGROUND OF THE INVENTION

This invention relates to a method and apparatus for rejecting nitrogen from a feed gas stream comprising methane and nitrogen so as to form a methane product.

It is known to extract natural gas from underground reservoirs. The natural gas often contains nitrogen. The nitrogen may be in part or totally derived from nitrogen which has been injected into the reservoir as part of an enhanced oil recovery (EOR) or enhanced gas recovery (EGR) operation. A feature of such operations is that the concentration of nitrogen in the natural gas tends to increase with the passage of time from about 5% by volume to about 60% by volume or higher.

U.S. Pat. No. 4,415,345 discloses a process for rejecting the nitrogen from the methane in a double rectification column operating at cryogenic temperatures. A double rectification column comprises a higher pressure rectification column, a lower pressure rectification column, and a condenser-reboiler placing the top of the higher pressure rectification column in indirect heat exchange with a region, usually the bottom, of the lower pressure rectification column. In the process according to U.S. Pat. No. 4,415,345 a stream of a mixture of nitrogen and methane is cooled at elevated pressure to a temperature suitable for its separation by rectification. A part of the feed gas is liquefied. The resulting gas mixture is separated by rectification. In one embodiment described in U.S. Pat. No. 4,415,345 a double rectification column is employed to carry out the separation. A liquid methane product is withdrawn from the bottom of the lower pressure rectification column and is raised in pressure by a pump. A waste nitrogen stream is withdrawn from the top of the lower pressure rectification column and is discharged from the plant.

The methane product is typically required at a similar pressure to that at which the natural gas is supplied, for example, typically in the order of 40 bar. With relatively high methane feed purity in the order of 95% it is possible to pump the liquid methane product to about 25 bar upstream of its vaporisation which is effected by indirect heat exchange with the incoming feed gas. The vaporised product methane may be raised further in pressure by compression.

As the mole fraction of methane in the feed gas decays and the mole fraction of nitrogen in it rises, so the feed gas becomes easier to separate. A designer of a separation plant faces the choice of whether to generate sufficient refrigeration so as to ensure that there is a high recovery of methane in the product stream throughout the operation of the plant, potentially at the cost of providing refrigeration circuits that are unnecessary at higher nitrogen mole fractions in the feed gas, or to exclude such circuits at the cost of a much lower methane recovery in the product stream at lower nitrogen mole fractions.

SUMMARY OF THE INVENTION

It is an aim of the present invention to provide a method and apparatus which reduces the need for a high methane recovery in the methane product.

According to the present invention there is provided a method of rejecting nitrogen from a feed natural gas stream comprising methane and nitrogen so as to form a primary methane product, the mole fraction of nitrogen in the feed natural gas increasing over a period of time, the method comprising cooling the feed natural gas stream, rectifying the cooled natural feed gas stream, and withdrawing from the rectification a primary product methane stream and a secondary nitrogen-enriched product stream from the rectification, wherein the secondary nitrogen-enriched product stream has a mole fraction of methane at or above a chosen minimum value when the said mole fraction of nitrogen is at a minimum, characterised in that when the said mole fraction of nitrogen rises to a value at which the mole fraction of methane in the secondary nitrogen-enriched product stream falls below the chosen minimum, a part of the feed gas is introduced into the secondary nitrogen-enriched product stream so as to restore its mole fraction of methane to the chosen minimum value or a value thereabove.

The invention also provides apparatus for performing the method defined in the immediately preceding paragraph, comprising a feed natural gas pipeline communicating with a main heat exchanger for cooling the feed natural gas stream; a rectification column for rectifying the cooled feed natural gas stream having a first outlet for the primary product methane stream and a second outlet for the secondary nitrogen-enriched product stream, a first product pipeline communicating with the first outlet, and a second product pipeline communicating with the second outlet, characterised by a conduit able to be selectively opened so as to place the second product pipeline in communication with the feed natural gas pipeline.

The method and apparatus according to the invention make it possible to use the secondary nitrogen-enriched product streams of fuel gas not only when the mole fraction of nitrogen in the feed natural gas is at a minimum but also when the mole fraction of nitrogen in the feed natural gas stream is greater than its minimum value. Employing the secondary nitrogen-enriched stream as a fuel gas reduces the criticality of a high recovery of methane in the primary product. Accordingly, the method according to the invention preferably does not employ any heat pumping from a colder region to a warmer region of the rectification. In addition, it is preferred that all the refrigeration for the method and apparatus according to the invention is generated entirely by Joule-Thomson expansion or by turbine expansion of one or more liquid streams, or by a combination of such turbine expansion and Joule-Thomson expansion.

The rectification is preferably performed in a double rectification column comprising a higher pressure rectification column, a lower pressure rectification column, and a condenser-reboiler placing the higher pressure rectification column in heat exchange relationship with the lower pressure rectification column. Alternatively, a single rectification column may be used.

The primary product methane stream is preferably withdrawn in liquid state, is raised in pressure, and is vaporised. At least part of the vaporisation of the primary product methane stream is preferably performed by indirect heat exchange with the feed natural gas stream. The indirect heat exchange is preferably performed in the main heat exchanger.

BRIEF DESCRIPTION OF THE DRAWINGS

The method and apparatus according to the invention will now be described by way of example with reference to the accompanying FIGURE which is a schematic flow diagram of a first nitrogen rejection plant according to the invention.

The FIGURE is not to scale.

DETAILED DESCRIPTION OF THE INVENTION

A feed stream of natural gas is recovered by known means not forming part of this invention from an underground oil or gas reservoir. The stream is typically recovered at a pressure in the order of 40 bar and may initially contain from 5 to 10% by volume of nitrogen. The natural gas stream may be subjected to preliminary treatment (not shown) in order to remove a range of impurities including any hydrogen sulphide and other sulphur-containing impurities therefrom. Such purification of natural gas is well known in the art and need not be referred to in further detail herein. After removal of any such hydrogen sulphide impurity, the elevated pressure methane-nitrogen stream may still typically contain water vapour impurity (or this impurity may have been in the initial treatment). The water vapour is removed by passage through a purification unit 2. The purification unit 2 preferably comprises a plurality of adsorption vessels containing adsorbent able selectively to adsorb water vapour from the feed gas stream. Such purification units typically operate on a pressure swing adsorption or a temperature swing adsorption cycle, the latter generally being preferred. If the feed gas stream also contains carbon dioxide impurity, the purification unit 2 can additionally contain an adsorbent selective for carbon dioxide so as to effect the carbon dioxide removal.

The resulting purified natural gas feed stream passes from the purification unit 2 along a feed gas pipeline 4 at approximately ambient temperature into a main heat exchanger 10. The natural gas feed stream flows through the main heat exchanger 10 from its warm end 12 to its cold end 14. The main heat exchanger 10 comprises a plurality of heat exchange blocks preferably joined together to form a single unit.

Downstream of the main heat exchanger 10, the feed gas stream is expanded through a throttling valve 16 (sometimes referred to as a Joule-Thomson valve) into a phase separator 18, this throttling being the primary source of cold to keep the plant in refrigeration balance. (Alternatively, if the feed gas stream leaves the cold end 14 of the main heat exchanger 10 essentially in liquid state a liquid turbine (not shown) may be substituted for the throttling valve 16.) Depending on its pressure, the feed gas stream is either liquefied in the main heat exchanger 10 or on expansion through the throttling valve 16. Typically, depending on its composition, at least 75 mole % of the feed gas stream is liquefied. In consequence, the vapour flow is reduced, thus making possible the use of a smaller diameter higher pressure rectification column than would otherwise be required. The vapour is disengaged from the liquid in the phase separator 18. A stream of the vapour phase flows from the top of the phase separator 18 through an inlet 26 into the bottom region of a higher pressure rectification column 22 forming part of a double rectification column 20 with a lower pressure rectification column 24 and a condenser/reboiler 25 thermally linking the top of the higher pressure rectification column 22 to the bottom of the lower pressure rectification column 24. A stream of the liquid phase flows from the bottom of the phase separator 18 into an intermediate mass exchange region of the higher pressure rectification column 22 through another inlet 30.

The feed gas mixture is separated in the higher pressure rectification column 22 into a vaporous nitrogen top fraction, (which nonetheless contains an appreciable mole fraction of methane) and a liquid methane-enriched bottom fraction. A stream of the methane-enriched bottom fraction is withdrawn from the higher pressure rectification column 22 through a bottom outlet 32 and is sub-cooled by passage through a further heat exchanger 34. The resulting sub-cooled methane-enriched liquid stream flows through a throttling valve 36 and is introduced into an intermediate mass exchange region of the lower pressure rectification column 24. In addition, a liquid stream comprising methane and nitrogen is withdrawn from an intermediate mass exchange region of the higher pressure rectification column 22 through an outlet 38, is sub-cooled by passage through the further heat exchanger 34, is passed through a throttling valve 40 and is introduced into a second intermediate mass exchange region of the lower pressure rectification column 24 located above the first intermediate mass exchange region.

The streams passing through the valves 36 and 40 are separated in the lower pressure rectification column 24 in order to form a primary product liquid methane fraction at the bottom of the rectification column 24 and a secondary nitrogen-enriched product vapour fraction at the top of the column 24. The double rectification column 20 is operated so that the top nitrogen vapour contains a large mole fraction of methane, particularly when the concentration of methane in the feed gas is at a maximum. A stream of the primary product fraction is withdrawn through a first outlet 48 from the lower pressure rectification column 24 and is raised in pressure by operation of the pump 50. The resulting pressurised liquid methane product stream is passed through the further heat exchanger 34 countercurrently to the streams being sub-cooled therein. The pressurisation of the primary product liquid methane stream has the effect of raising its pressure above its saturation pressure. Thus, in effect, the pressurised liquid methane product stream is in sub-cooled state as it enters the further heat exchanger 34. It is warmed in the further heat exchanger 34 to remove the sub-cooling. It is preferred that no vaporisation of the primary liquid methane product stream takes place in the further heat exchanger 34, although it may not prove possible on every occasion totally to avoid vaporisation of a small portion of the primary product stream.

The warmed primary liquid methane product stream passes from the heat exchanger 34 through the main heat exchanger 10 from its cold end 14 to its warm end 12. It is vaporised as it passes through the main heat exchanger 10. The vaporised primary methane product passes from the main heat exchanger 10 to a primary product pipeline 60 in which is disposed a product compressor 62, the product compressor 62 being employed to compress the product methane typically to a pressure in the order of 40 bar.

Reflux for the higher pressure rectification column 22 and the lower pressure rectification column 24 is formed by taking a stream of the top fraction from the higher pressure rectification column 22 and condensing it in the condensing passages of the condenser-reboiler 25. A part of the resulting condensate is returned to the higher pressure rectification column 22 as reflux. The remainder is sub-cooled by passage through the further heat exchanger 34 and is passed through a throttling valve 52 into the top of the lower pressure rectification column 24 and therefore provides liquid reflux for that column. A secondary nitrogen-enriched product vapour stream, which also contains methane, is withdrawn from the top of the lower pressure rectification column 24 through an outlet 54 and is warmed by passage through the further heat exchanger 34. The resulting warmed secondary nitrogen-enriched product stream is further heated to approximately ambient temperature by passage through the main heat exchanger 10 from its cold end 14 to its warm end 12. The thus heated secondary nitrogen-enriched product flow passes from the main heat exchanger 10 to a pipeline 80 and may be used as a fuel gas.

The mole fraction of methane in the secondary nitrogen-enriched product depends on the mole fraction of methane in the purified natural gas feed stream. In the event of the former mole fraction falling to a value at which the secondary product is not readily combustible, say below 0.4, a sufficient flow of the purified feed gas is withdrawn from the pipeline 4 and introduced via a conduit 90 into the pipeline 80 so as to raise the mole fraction of methane in the secondary product to a value (say 0.4 or above) at which it is readily combustible. The minimum methane mole fraction may depend on the use intended for the fuel and could be less than 0.4 for at least some uses. Typical uses include the firing of burners in boilers, gas turbines and heat recovery steam generator ducts.

In a typical example of the method according to the invention, the lower pressure rectification column 24 operates at a pressure in the order of 1.25 to 1.5 bar absolute at its top.

As an example, a purified feed natural gas stream contains 95% by volume of volume and 5% by volume of nitrogen. Initially, the plant shown in FIG. 1 may be operated to give a 92% methane recovery in the primary product stream. As a result, the secondary product stream contains about 60% by volume of methane. As such, it can be used as a fuel gas. As the feed natural gas stream becomes gradually more contaminated with nitrogen over time, the separation becomes easier and the methane recovery in the primary product increases.

Once the nitrogen concentration has reached a first given level, the methane mole fraction in the secondary product stream will fall to less than 0.4. A part of the purified feed gas stream is then passed along the conduit 90 into the secondary product stream so as to raise the mole fraction of methane therein to at least 0.4. By appropriately adjusting the rate at which purified feed gas is passed into the secondary product stream, the mole fraction of methane may be maintained at a chosen value therein. Desirably, this value is at least 0.4 so as to ensure that the secondary product stream is readily combustible. Eventually, say when the mole fraction of nitrogen in the feed gas stream reaches a second given level greater than the first level, the proportion of the purified feed gas that needs to be diverted to the secondary product so as to maintain the mole fraction of methane therein at the chosen value will be so great as to make it more economic to send the secondary product stream to an incinerator (or to a vent) and not to divert any of the feed gas stream to the secondary product stream.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

Having thus described the invention, what we claim is:

1. A method of rejecting nitrogen from a feed natural gas stream comprising methane and nitrogen so as to form a primary methane product, the moie fraction of nitrogen in the feed natural gas increasing over a period of time, the method comprising cooling said feed natural gas stream, rectifying said cooled natural feed gas stream, and withdrawing from the rectification a primary product methane stream and a secondary nitrogen-enriched product stream from the rectification, wherein said secondary nitrogen-enriched product stream has a mole fraction of methane at or above a chosen minimum value when the said mole fraction of nitrogen is at a minimum, and when the said mole fraction of nitrogen rises to a value at which the mole fraction of methane in the secondary nitrogen-enriched product stream falls below the chosen minimum, a part of the feed gas is introduced into the secondary nitrogen-enriched product stream so as to restore its mole fraction of methane to the chosen minimum value or a value thereabove.

2. The method as claimed in claim 1, not employing any heat pumping from a colder region to a warmer region of the rectification.

3. The method as claimed in claim 1, wherein all the refrigeration for the method is generated by Joule-Thomson expansion.

4. The method as claimed in claim 1, wherein all the refrigeration for the method is generated by turbine expansion of one or more liquid streams.

5. The method as claimed in claim 1, wherein all the refrigeration for the method is generated by a combination of turbine expansion of one or more liquid streams and Joule-Thomson expansion.

6. The method as claimed in claim 1, wherein the rectification is performed in a double rectification column comprising a higher pressure rectification column, a lower pressure rectification column, and a condenser-reboiler placing the higher pressure rectification column in heat exchange relationship with the lower pressure rectification column.

7. The method as claimed in claim 1, in which the primary product methane stream is withdrawn from the rectification in liquid state, is raised in pressure and is vaporised.

8. The method as claimed in claim 7, in which at least part of the vaporisation of the primary product methane stream is performed by indirect heat exchange with the feed natural gas stream.

9. The method as claimed in claim 1, in which the chosen minimum mole fraction of methane in the secondary nitrogen-enriched product stream is 0.4.

10. An apparatus for rejecting nitrogen from a feed gas stream comprising methane and nitrogen, comprising a feed natural gas pipeline for obtaining the feed gas stream from a source of a mixture of nitrogen and methane whose nitrogen mole fraction can increase with the passage of time, a main heat exchanger for cooling the feed natural gas stream in communication with the feed natural gas pipeline; a rectification column for rectifying the cooled feed natural gas stream having a first outlet for a primary product methane stream and a second outlet for a secondary nitrogen-enriched product stream, a first product pipeline communicating with the first outlet, and a second product pipeline communicating with the second outlet, wherein the apparatus additionally comprises a conduit able to be selectively opened so as to place the second product pipeline in communication with the feed natural gas pipeline, whereby a part of said feed gas stream is able to flow into said nitrogen-enriched product stream to restore its mole fraction of methane to a chosen minimum value or higher.

11. The apparatus as claimed in claim 10, wherein the rectification column is a double rectification column comprising a higher pressure rectification column, a lower pressure rectification column, and a condenser-reboiler placing the higher pressure rectification column in heat exchange relationship with the lower pressure rectification column.

12. The apparatus as claimed in claim 11, additionally including a pump for withdrawing the primary product stream in liquid state from the lower pressure rectification column and for raising the primary product stream in pressure.

* * * * *

UNITED STATES PATENT AND TRADEMARK OFFICE

CERTIFICATE OF CORRECTION

PATENT NO. : 7,059,152 B2
APPLICATION NO. : 10/701702
DATED : June 13, 2006
INVENTOR(S) : John Douglas Oakey and Brian Morice Davies It is certified that error appears in the above-identified patent and that said Letters Patent is hereby corrected as shown below:

In column 5, line 52, replace “moie” with --mole--.

Signed and Sealed this

Twenty-second Day of August, 2006

JON W. DUDAS
*Director of the United States Patent and Trademark Office*